United States Patent [19]

Kaji et al.

[11] 4,147,260

[45] Apr. 3, 1979

[54] APPARATUS COLLECTING PIPES AND THE LIKE

[75] Inventors: Kunio Kaji, Osaka; Hideo Azuma, Otsu; Kunio Iwade, Hagashiosaka, all of Japan

[73] Assignee: Hankyu Zouki Kogyo Kabushiki Kaisha, Osaka, Japan

[21] Appl. No.: 868,410

[22] Filed: Jan. 10, 1978

[30] Foreign Application Priority Data

Oct. 25, 1977 [JP] Japan ..... 52-128285

[51] Int. Cl.[2] ..... B30B 5/04

[52] U.S. Cl. ..... 414/98; 100/212; 414/748

[58] Field of Search ..... 214/1 P, 1 PB, 6 H, 214/8; 100/7, 212

[56] References Cited

U.S. PATENT DOCUMENTS

| | | | |
|---|---|---|---|
| 3,045,846 | 7/1962 | Clark | 214/1 PB X |
| 3,214,001 | 10/1965 | Callaghan | 214/1 PB X |
| 3,837,465 | 9/1974 | Klusmier et al. | 214/6 H X |
| 3,956,982 | 5/1976 | Hill et al. | 214/6 H X |

FOREIGN PATENT DOCUMENTS

| | | | |
|---|---|---|---|
| 969007 | 4/1958 | Fed. Rep. of Germany | 214/1 PB |

*Primary Examiner*—L. J. Paperner

*Attorney, Agent, or Firm*—Browdy and Neimark

[57] ABSTRACT

An apparatus which collects pipes, rods and similar objects parallel one another, to form a bundle. The apparatus includes at least one pair of transfer rails from which the pipes are transferred to a pair of roller chains where the pipes are collected. The roller chains are mounted on driving sprockets, swing sprockets, feed sprockets and take-up sprockets. The velocity of the take-up sprockets is lower than the velocity of the feed sprockets, causing the roller chain to sag therebetween, creating a space to collect the pipes.

5 Claims, 8 Drawing Figures

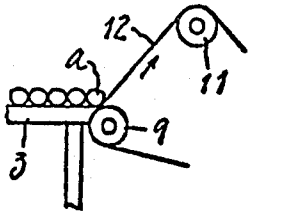
FIG. 3
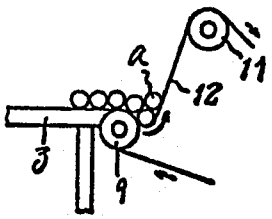
FIG. 4
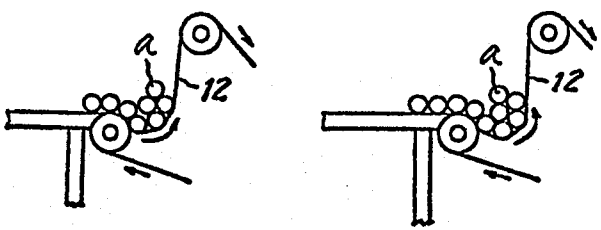
FIG. 5
FIG. 6
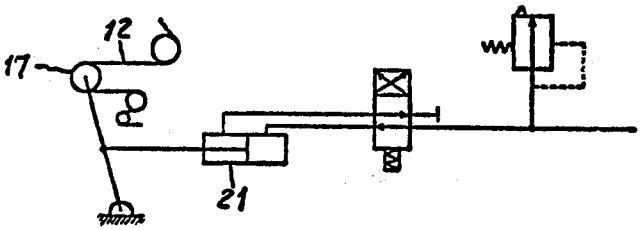
FIG. 7
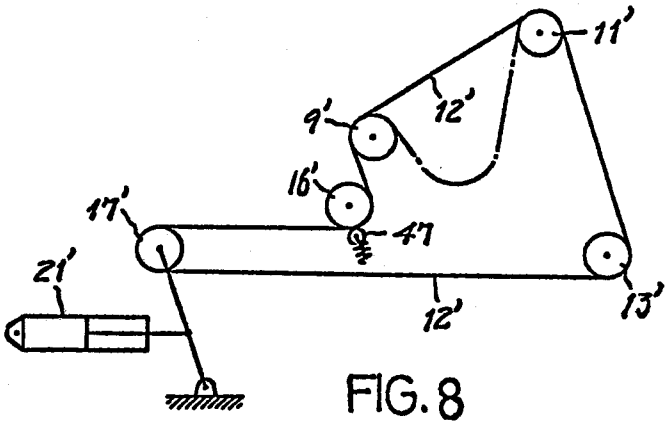
FIG. 8

APPARATUS COLLECTING PIPES AND THE LIKE

FIELD OF THE INVENTION

The present invention relates to an apparatus for regularly collecting pipes, rods and similar objects.

BACKGROUND OF THE INVENTION

An apparatus is already known in which a transfer rail is connected with a U-shaped rigid rack at the tip thereof, to a receiving rack; pipes or similar objects are transfered from the rail down into the receiving rack. The known apparatus has some defects, for example, a loud noise is made when the pipes collide with each other. The surfaces of the pipes are also injured as the result of the collision. Another kind of apparatus has been developed in order to eliminate these defects. An inclining flexible belt is substituted in place of the above-described U-shaped rack. The belt, in the latter apparatus, is positioned at the end of the transfer rail and receives the pipes continuously one by one into its hollow space. The receiving space become gradually bigger and deeper as the belt is pulled downward by the weight of the pipes; the greater the number of pipes, the further the belt is pulled downward, until some limit is reached. The pipes received onto the belt stand in a row until the last pipe is flush with the transfer rail. Succeeding pipes entering into the space will fiercely roll down over the row of the pipes already received, thereby making loud noise and damaging the surface of the pipes. In addition, the pipes, are so irregularly collected into the belt space that they can not be easily bundled and lifted upward.

SUMMARY OF THE INVENTION

The present invention offers an apparatus which collects pipes, rods and similar articles parallel to each other, and which includes a transfer rail and a pair of roller chains supported by a device comprising a pair of feed sprockets, a pair of take-up sprockets, a pair of swing sprockets and a pair of front and rear props. The feed sprockets are rotatably fixed on the upper portion of the front props. The take-up sprockets are rotatably fixed on the upper portion of the rear props. The feed sprockets drive the roller chains faster than the take-up sprockets. Thus, the roller chains between the feed sprockets and the take-up sprockets will expand downward by the swinging motion of the swing sprockets. The section of the roller chains between the feed sprockets and take-up sprockets receives the pipes.

The apparatus in accordance with the present invention can receive pipes or similar articles smoothly and in regular sequence. The pipes are regularly collected to form an equilateral polygon when viewed from the side.

The structure of the apparatus will be understood and certain of its advantages more fully appreciated from the detailed description which follows, read in connection with the accompanying drawings illustrating practical embodiments of the apparatus in which the invention may be practiced.

IN THE DRAWINGS

BRIEF DESCRIPTION OF THE DRAWINGS

FIGS. 3,4,5 and 6 are diagrammatic side plan views of the first embodiment of the invention showing the process of collecting the pipes;

FIG. 7 is a diagrammatic side plan view showing the oil-hydraulic system in said first embodiment of the invention; and FIG. 8 is a diagrammatic side plan view of a second embodiment of the invention.

DETAILED DESCRIPTION OF THE PREFERRED EMBODIMENT

Figure 1:
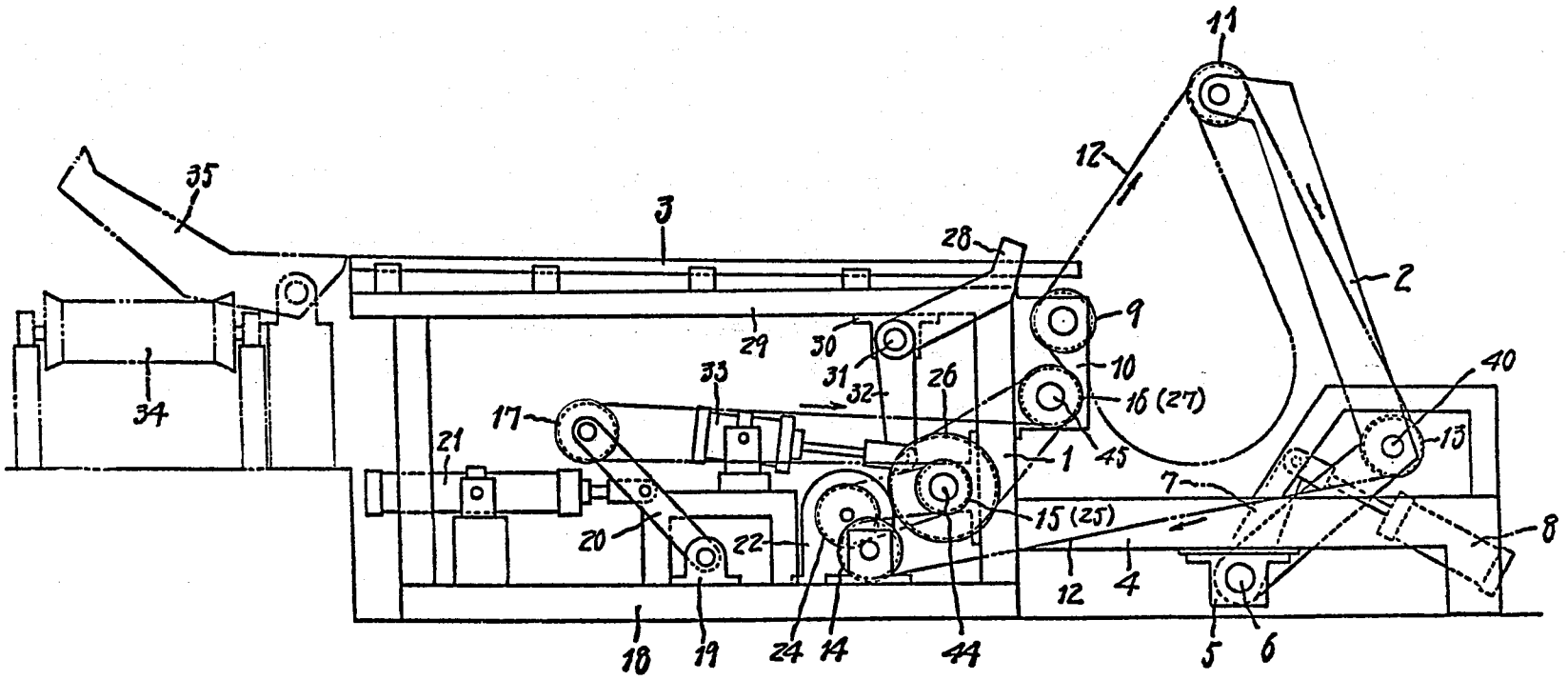
FIG. 1 is a side plan view of a first embodiment of the invention.
Figure 2:
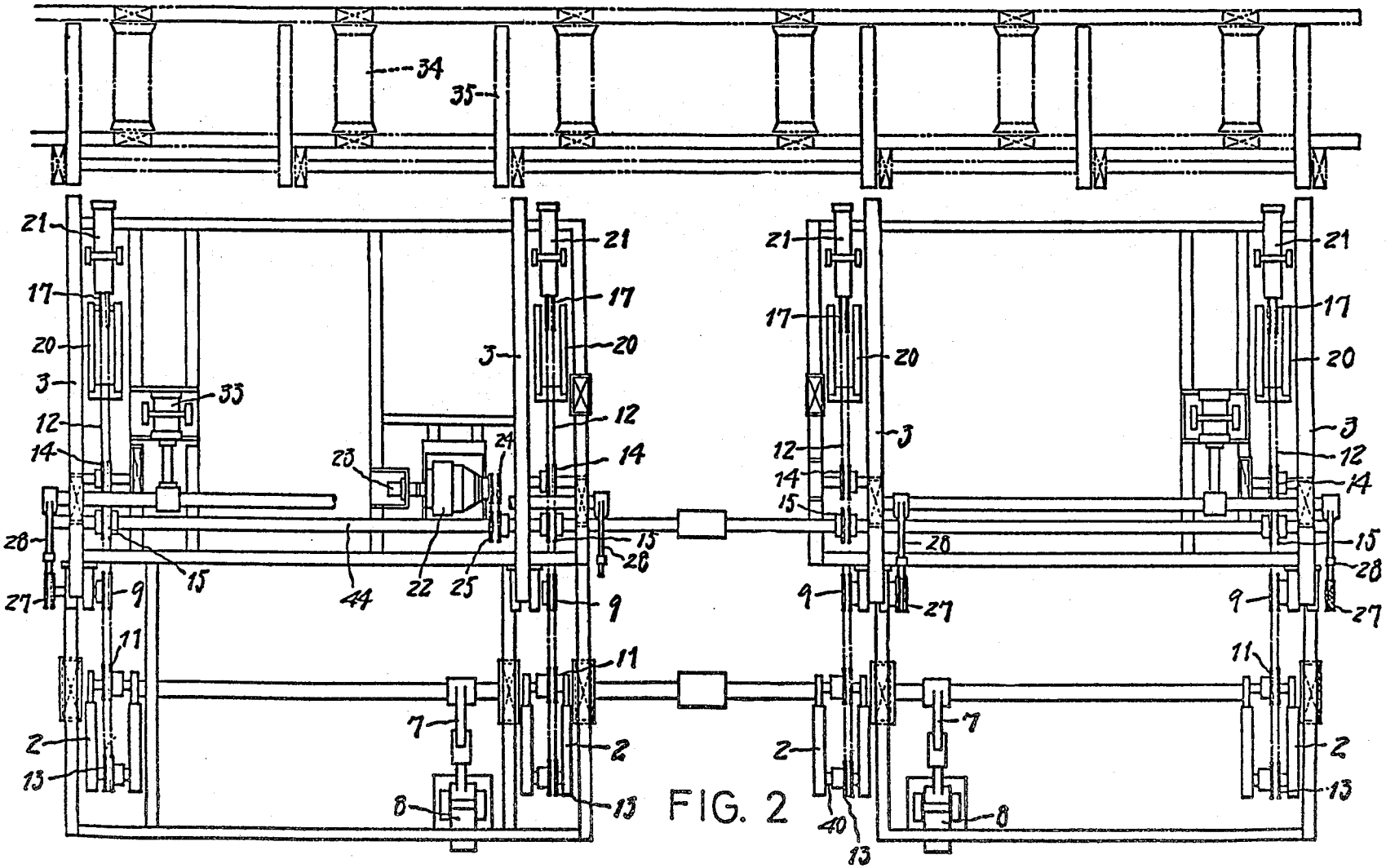
FIG. 2 is a top plan view of the first embodiment of the invention.

Referring now to FIG. 1 and FIG. 2, 1 and 2 show, respectively, the front and rear props located at certain intervals. The rear props 2 are higher than the front props 1. The right and left sides of the apparatus are equipped with props 1 and 2. The top end of the front props 1 are connected to inclined transfer rails 3 and the lowest end thereof. The rear props 2 which are elbow-shaped and project backward, are fixed to a shaft 6.

The shaft 6 is rotatable within certain angular limits and is supported by bearings 5 fixed to the lower surface of the bottom frame 4. Levers 7 are also fixed at one end to the shaft 6, and connected at their other end to fluid-cylinders 8. Thus, the above-mentioned rear props 2 can be caused to swing forward and backward by the levers 7, driven by the fluid-cylinders 8.

Each feed sprocket 9 is fixed revolvably upon the top of a bracket 10, attached to the upper portion of the props 1. The sprockets 9 stand close to the tip ends of the transfer rails 3. The symbol 11 indicates take-up sprockets fixed revolvably upon the top of the rear props 2. The take-up sprockets 11 and the feed sprockets 9 are idle wheels of the same diameter. The symbol 12 indicates endless flexible strips of roller chains. The roller chains 12 are mounted on the feed sprockets 9, the take-up sprockets 11, intermediate sprockets 13, 14, driving sprockets 15, 16 and swing sprockets 17. The roller chains 12 rotate in the direction indicated by the arrows in FIG. 1. Intermediate sprockets 13 are fixed to the lower portion of the rear props 2, and the other intermediate sprockets 14 are fixed to the rear bottom portion of frame bases 18. The driving sprockets 15 are fixed to a shaft 44, supported rotatably by the rear end portions of the bases 18, half way up the bases 18. The other driving sprockets 16 are fixed to a shaft 45 rotatably supported upon the brackets 10, at the lower portions thereof. Sprockets 13–17 have the same diameter as the foregoing sprockets 9 and 11.

The swing sprockets 17 are freely rotatably fixed upon the top of levers 20 supported by the frame bases 18. The levers 20 are caused to swing forward and backward by fluid-cylinders 21 within certain angular limits.

The symbol 22 indicates a cyclo-reduction gear driven by an oil-hydraulic motor 23. A pinion 24, installed onto the output shaft of the cyclo-reduction gear 22, drives, via a chain 54, a sprocket 25, fixed to the above-mentioned shaft 44, holding the driving sprockets 15. The pinion 24 further drives, via chain 54, and large sprockets 26, sprockets 27 which are fixed to the shafts 45, holding the driving sprockets 16. In this way, the roller chains 12 are driven in the direction indicated by the arrow in FIG. 1.

It will be understood from the above description that the driving sprockets 16 are devised so as to rotate faster than the driving sprockets 15. The diameter of the sprockets 26 is larger than that of the sprockets 27, and the sprockets 26 and 27 are connected respectively to driving sprockets 15 and 16 through respective common shafts 44 and 45. Therefore, the speed of the part of the roller chains 12 engaging feed sprockets 9 under the direct influence of the driving sprockets 16, is greater than the speed of that part of the same roller chains engaging the take up sprockets 11, under the indirect influence of the driving sprockets 15 through the intermediate sprockets 14 and 13. Because of the difference in the speeds of various parts of roller chains 12, the roller chains 12 will hang down between sprockets 9 and 11.

The symbol 28 indicates stoppers. The bottom ends of the stoppers 28 are fixed to a shaft 31, supported rotatably with bearings 30. The bearings 30 are attached to the lower surfaces of frame tops 29, said frame tops 29 supporting the transfer rails 3 at the upper surfaces thereof. The symbol 32 indicates levers whose top ends are fixed to the shafts 31, and whose bottom ends are joined to fluid-cylinders 33. Accordingly, when the fluid cylinders 33 are actuated the top portions of the stoppers 28 are raised above the transfer rails 3 and then brought down below the transfer rails 3.

A roller conveyor 34 is positioned near the entrance of the transfer rails 3 at right angles thereto. The symbol 35 indicates kickers supplying the pipes or similar articles to the rails 3 from the said conveyor 34.

The operation of the embodiment having the construction described above is explained as follows.

The rear props 2 are tilted slightly forward by the motion of the fluid-cylinders 8. The fluid-cylinders 21 are then activated and the swing sprockets 17 are shifted to their most forward position by the levers 20. The roller chains 12 are consequently stretched and straightened between the feed sprockets 9 and the take-up sprockets 11. Further, the stoppers 28 are lifted above the transfer rails 3 by the motion of the fluid-cylinders 33, acting through the levers 32.

In the above state of the apparatus, the pipes or similar articles on the roller conveyor 34 are then supplied in order, onto the transfer rails 3 by the kickers 35. Those pipes will roll down toward the stoppers 28 and rest on transfer rails 3, thereupon lying in a parallel row. Next, the stoppers 28 are retracted to put the forefront pipe "a" in contact with the roller chains 12 supported under tension by the feed sprockets 9 and the take-up sprockets 11, as shown in FIG. 3.

The cyclo-reduction gear 22 is now put into operation to drive-pinion 24. The pinion 24 drives the sprocket 25 by means of a chain 54. The large sprockets 26, fixed to the same shaft as said sprocket 25, will drive, in turn, the sprockets 27. The driving sprockets 15 are fixed to the same shaft 44 as sprockets 26, and the driving sprockets 16 are fixed to the same shaft 45 as sprockets 27. Thus, driving sprockets 15 and 16 drive the roller chains 12 in the direction indicated by the arrows in FIG. 1. It will be here noted that the driving sprockets 16 make more revolutions per minute than driving sprockets 15, because of the larger diameter of the sprockets 26 compared with that of the sprockets 27. As a result, the feed sprockets 9 driven by the sprockets 16 will make more revolutions than the take-up sprockets 11 driven by the sprockets 15 through the sprockets 14 and 13.

Consequently, the length of the roller chains 12 fed by the feed sprockets 9 is longer than that taken up by the take-up sprockets 11. The roller chains 12 will thus be loosened between said feed sprockets 9 and take-up sprockets 11. At the same time, the roller chains 12 are stretched at the front (entrance) side of the feed sprockets 9.

The swing sprockets 17 will be subsequently drawn toward the feed sprockets 9 by the power of the fluid-cylinders 21, stressing the roller chains 12 as shown in FIG. 7. In this way, the roller chains 12 will hang gradually deeper and deeper between the said feed sprockets 9 and take-up 11, moving toward the latter sprockets.

The pipes are delivered one by one to roller chains 12, and are moved along with the roller chains 12. The pipes are received into the space made by the roller chains 12 and bundled up thereby into a bundle in the shape of regular polygon when viewed from the side shown in FIGS. 4,5 and 6.

The horizontal distance "A" between the feed sprockets 9 and the take-up sprockets 11 should be preferably increased when the number of pipes to be received is increased. As a result of experiments, the relation shown in Table 1 between said distance "A" and the number of the pipes to be received, was found to give good performance by the apparatus;

Table 1

| Number of pipes or the like received | Horizontal distance "A" between the feed and take-up sprockets |
|---|---|
| 0~7 | 2D |
| 8~19 | 3D |
| 20~37 | 4D |

where "D" signifies the diameter of the pipes or similar articles.

In regard to the ratio of the peripheral velocity of the feed sprockets 9 to that of the take-up sprockets 11, it was found that the ratio should be decreased when the number of pipes or similar articles to be received increases. According to experimental results, the relation between said parameters as shown in Table 2 was found to be desirable for satisfactory performance of the apparatus;

Table 2

| Number of pipes received | Ratio of the peripheral velocity of the feed sprockets 9 to that of the take-up sprockets 11 |
|---|---|
| ~9 | 2:1 |
| 19~37 | 1.75:1 |
| 37~61 | 1.5:1 |

where the ratio 1.66:1 is taken as an average value.

After the predetermined number of the pipes or similar articles on the transfer rails 3 have been received into the hollow space formed by the roller chains 12, the fluid-cylinders 33 are then operated to raise up the stoppers 28 above the rails 3. The stoppers 28 be held there until the next cycle will starts. The cyclo-reducing gear 22 is simultaneously stopped to rest the roller chains 12. The fluid-cylinders 8 are next put into operation to rotate the rear props 2 backward. The distance between the feed sprockets 9 and take-up sprockets 11 is thus so enlarged that the received pipes or similar articles may be easily taken out from the above mentioned space.

In addition to the above operations, the fluid cylinders 21 are then activated bringing the swing sprockets 17 forward by the motion of the levers 20; the roller chains 12 are simultaneously circulated in the reverse direction by the reverse revolution of the feed sprockets 9, and the take-up sprockets 11. The roller chains 12 are in this way stretched again between the feed sprockets 9 and the take-up sprockets 11.

The roller chains 12 are used as endless flexible strips in the embodiment described above. However, the present invention is not restricted to using roller chains 12 to function as flexible strips. A kind of timing belt, for example, can be adoped. In addition, ordinary belts might be used as shown in FIG. 8. In this said embodiment, an endless ordinary belt 12' is mounted over feed wheels 9', take-up wheels 11', lower intermediate wheels 13', swing wheels 17' and driving wheels 16'.

The swing wheels 17' are capable of moving forward and backward under the action of the piston rods of the fluid-cylinders 21. Accordingly, said swing wheels 17' stretch up or loosen the belt 12' between the feed wheels 9' and the take-up wheels 11', in the same manner as in the first embodiment. When occasion demands, the apparatus is equipped with a pinch wheel 47 engaging the driving wheels 16'. The pinch wheel 47 thrusts the belt 12' upon the wheel 16' giving a stronger tension to the portion of the belt 12' and not between the wheels 9' and 11'.

As described above, the structure of the apparatus in the present invention is summarized as follows. The rear props 2 are located to the rear of the front props 1, said rear props 2 being higher than said front props 2. The right and left sides of the apparatus are equipped with front props 1 and rear props 2; feed wheels or sprockets 9, 9' and the take-up wheels or sprockets 11, 11' are rotatably supported, respectively on the tops of said front props 1 and rear props 2; the roller chains 12 or ordinary belts 12' are mounted onto said feed and take-up wheels or sprockets 9,11 or 9', 11' and the swing wheels 17 or swing sprockets 17' moved forward, to the feed wheels 9' or feed sprockets 9 and backward; the driving mechanism for said roller chains 12 or belts 12' circulating said roller chains 12 or belt 12' from the feed wheels 9' or feed sprockets 9 to the take-up wheels 11' or take-up sprockets 11; said driving mechanism also causes the feed wheels 9' or feed sprockets 9 to be rotated with higher peripheral velocity than the take-up wheels 11 or take-up sprockets 11.

As a result of the operation of the above-mentioned structure, said roller chains 12 or belts 12', receiving the pipes or similar articles, move in the direction from the feed sprockets 9 or feed wheels 9' to the take-up wheels 11' or take-up sprockets 11, and are simultaneously pulled down gradually, between the feed sprockets 9 or feed wheels 9' and take-up wheels 11' or take-up sprockets 11.

The many advantages over prior conventional apparatuses include: the pipes or similar articles are quietly and softly received without any harsh collision thereamong; the pipes or similar articles already received move together with the roller chains 12 or belts 12', thus smoothing the way for the next pipe or similar articles; the pipes or the like are protected from damages and injuries; and the pipes or similar articles are automatically gathered to make a preliminary polygonal assemblies for easier succeeding operations, such as tying, hoisting and carrying out.

What is claimed is:

1. An apparatus for collecting pipes and similar articles comprising at least one pair of front props erected at a certain distance from each other; at least one pair of rear props located to the rear of the front props, each rear prop being higher than said front props; at least one pair of feed means, each feed means being rotatably fixed upon the top of one of said front props; at least one pair of take-up means, each take-up means being rotatably fixed upon the top of one of said rear props; at least one pair of swing means movable forward and backward; at least one pair of flexible pipe receiving means mounted on said feed means, said take-up means, and on said swing means; and driving means for driving said pipe receiving means from said feed means to said take-up means, the peripheral velocity of said take-up means being lower than that of said feed means, and said number of pairs of front props, rear props, take-up means, feed means, swing means, pipe receiving means, and driving means all being equal.

2. An apparatus for collecting pipes and similar articles according to claim 1, wherein said feed means are feed sprockets, said take-up means are take-up sprockets, said swing means are swing sprockets, said flexible pipe receiving means are flexible roller chains, and said driving means are driving sprockets.

3. An apparatus for collecting pipes and similar articles, according to claim 1, wherein said feed means are feed wheels, said take-up means are take-up wheels, said swing means are swing wheels, said flexible pipe receiving means are flexible belts, and said driving means are driving wheels.

4. An apparatus for collecting pipes and similar articles, according to claim 1, wherein said pair of rear props is movable forward and backward.

5. An apparatus for collecting pipes and similar articles, according to claim 1, further including at least one pair of inclined transfer rails for feeding the pipes to said flexible pipe receiving means, said transfer rails being connected to said front props.

* * * * *